United States Patent [19]

Harrewijne et al.

[11] 3,935,708

[45] Feb. 3, 1976

[54] DEVICE FOR CONVERTING CALORIFIC ENERGY INTO MECHANICAL ENERGY

[75] Inventors: Arend Harrewijne; Albertus Peter Johannes Michels; Franciscus Wilhelmus Engelbert Gasseling, all of Eindhoven, Netherlands

[73] Assignee: U.S. Philips Corporation, New York, N.Y.

[22] Filed: June 3, 1974

[21] Appl. No.: 475,831

[30] Foreign Application Priority Data

June 13, 1973 Netherlands ..... 7308176

[52] U.S. Cl. ..... 60/517; 123/119 A; 431/115

[51] Int. Cl.² ..... F02G 1/04; F23N 1/04

[58] Field of Search ..... 431/115, 116; 60/516, 517, 60/524, 526, 39.52, 39.27, 39.28, 39.29, 278, 279; 123/119 A

[56] References Cited

UNITED STATES PATENTS

| | | | |
|---|---|---|---|
| 2,649,686 | 8/1953 | Lawrence et al. | 60/39.28 R |
| 3,846,985 | 11/1974 | Johannes et al. | 123/119 A |

*Primary Examiner*—Allen M. Ostrager
*Attorney, Agent, or Firm*—Frank R. Trifari; J. David Dainow

[57] ABSTRACT

An engine including a combustion chamber having connected thereto a combustion-air inlet duct in which a first restriction is incorporated, and a flue-gas return duct incorporating a second restriction connected to a part of the combustion air duct which is situated between the combustion chamber and the first restriction.

5 Claims, 4 Drawing Figures

DEVICE FOR CONVERTING CALORIFIC ENERGY INTO MECHANICAL ENERGY

BACKGROUND OF THE INVENTION

The invention relates to a device for converting calorific energy into mechanical energy, comprising at least one combustion chamber having connected thereto at least one inlet duct for fuel, at least one inlet duct for combustion air in which a first restriction is incorporated, and at least one outlet duct for flue gases. A flue-gas return duct is provided having an inlet and an outlet, the inlet being connected to the flue gas outlet duct and the outlet to the part of the combustion air inlet duct which is situated between the combustion chamber and the first restriction. The flue gas return duct incorporates a second restriction which is constructed such that the mass flow of flue gas which passes through in each operating condition of the device is at least substantially proportional to the root of the pressure difference prevailing across the second restriction.

A device of the kind set forth has been proposed in the U.S. Pat. No. 3,846,985 in the name of Applicant. Devices of this kind are, for example, hot-gas reciprocating engines, hot-gas turbines, internal combustion engines and the like. In these known devices a part of the flue gasses discharged from the device is branched off and, after mixing with combustion air, is returned to the combustion chamber. Because of their heat capacity the returned flue gases ensure that the combustion temperature in the combustion chamber does not become too high. It is thus achieved that nitrogen oxides are formed only to a limited extent. This is because the production of health-hazardous nitrogen oxides increases strongly as the temperature at which the combustion of the air-fuel mixture takes place is higher. Consequently, devices of this kind offer the advantage that air pollution is minimized.

By the use of a turbulent restriction in the flue-gas return duct and a laminar restriction in the combustion air inlet duct it is automatically achieved in the proposed device that when at small loads of the device, when comparatively small quantities of combustion air are supplied, comparatively large quantities of flue gas are recirculated, while in the case of large loads, when comparatively large quantities of combustion air are supplied to the device, comparatively small quantities of flue gas are recirculated.

The fact that a comparatively large quantity of flue gas is recirculated in the case of small loads is particularly attractive in hot-gas engines and internal combustion engines for traction purposes. These engines usually have a small load in city traffic, and air pollution should be minimized particularly in these circumstances.

In these circumstances a comparatively large recirculation of flue gases not only ensures that only small quantities of nitrogen oxides are produced, but also only a small quantity of carbon monoxide. Moreover, also the presence of non-combusted carbon hydrates and soot in the exhaust gases is prevented. The latter is so because the flue gases ensure proper mixing of air and fuel, which results in proper combustion. The fact that a comparatively small flue gas recirculation takes place in the case of large loads offers the advantage for the hot-gas engine and the hot-gas turbine that the combustion air fan, also drawing in flue gas, may be of a comparatively small power and small dimensions, while in the case of the internal combustion engine the maximum power to be delivered is only slightly reduced by the recirculation.

It was found that the favorable flue gas recirculation characteristic thus obtained, is disturbed if the part of the flue gas outlet duct which is situated beyond, viewed downstream, its connection with the flue gas return duct has an excessive flow resistance. This in fact concerns the actual exhaust pipe.

Because of the excessive flow resistance, the pressure which prevails at the area where the inlet of the flue-gas return is connected to the flue-gas outlet duct is not ambient pressure, but rather the ambient pressure increased by the pressure drop across the exhaust pipe. Because the flow through the exhaust pipe is normally turbulent and the pressure drop across the pipe, consequently, is proportional to the square of the mass flow of flue gas through this pipe, the pressure drop strongly increases in the case of larger loads. As a result, the mass flow of flue gas returned to the combustion chamber at these larger loads also increases. The favorable flue gas recirculation characteristic according to which comparatively little flue gas is returned in the case of comparatively large loads is thus lost. A reduced flow resistance of the exhaust pipe by a reduction of the pipe length is usually not feasible in vehicles, while an increased pipe diameter is undesirable in view of space and material cost price considerations.

SUMMARY OF THE INVENTION

The invention has for its object to provide a structurally simple solution to the above-described problem. To this end, the device according to the invention is characterized, in that the first restriction is constructed such that the mass flow of air passing through in each operating condition of the device is proportional to the power M of the pressure difference prevailing across the first restriction, where $1 < M \leq 3/2$.

The indicated passage characteristic of the restriction in the combustion air inlet duct again results in a flue gas recirculation characteristic according to which a comparatively large quantity of flue gas is returned in the case of comparatively small loads, and a comparatively small quantity of flue gas is returned in the case of comparatively large loads.

The restriction in the combustion air inlet duct may be a control member (control valve, choke valve) which is operated by the air flow.

In addition to the purpose of obtaining a favourable flue gas recirculation characteristic for the device, the first restriction can at the same time be advantageously used, notably on account of its passage characteristic, in the air fuel control system of a hot-gas reciprocating engine.

To this end, a preferred embodiment of the device, constructed as a hot-gas reciprocating engine in which the ratio of the quantities of combustion air and fuel to be supplied to the combustion chamber is controlled by way of a control system comprising a control member which is controlled by signals originating from pressure-difference gauges in the combustion air inlet duct and the fuel inlet duct, respectively, is characterized in that the first restriction constitutes the pressure-difference gauge in the combustion air inlet duct, whilst the pressure-difference gauge in the fuel inlet duct is formed by a third restriction of a construction such that the mass flow of fuel which passes through in each operating condition of the hot-gas reciprocating engine is proportional to the power N of the pressure difference prevailing across the third restriction, where $N = M$.

In a hot-gas reciprocating engine which is known from British Patent Specification No. 895,869, the pressure-difference gauge in the fuel duct consists of a set of measuring plates, while that in the combustion air duct is a venturi. For both meters the pressure difference is proportional to the square of the mass flow passing therethrough. In usual fuel flows where the smallest and the largest flow relate as 1:50, the smallest and the largest pressure difference then relate as 1:2500. The control member must satisfy very severe requirements so as to enable proper control within such a large range. According to the invention this is no longer necessary. In the device according to the invention the pressure difference is, for example, proportional to the power ⅔ of the mass flow (this is because the mass flow is then proportional to the power 3/2 of the pressure difference). A 1:50 ratio of the smallest flow and the largest flow then means a pressure difference ratio of only 1:3.16. The control member can be of a simple and inexpensive construction because of this small control pressure range.

The invention will be described in detail hereinafter with reference to the diagrammatic drawing which is not to scale.

Figure 2A:
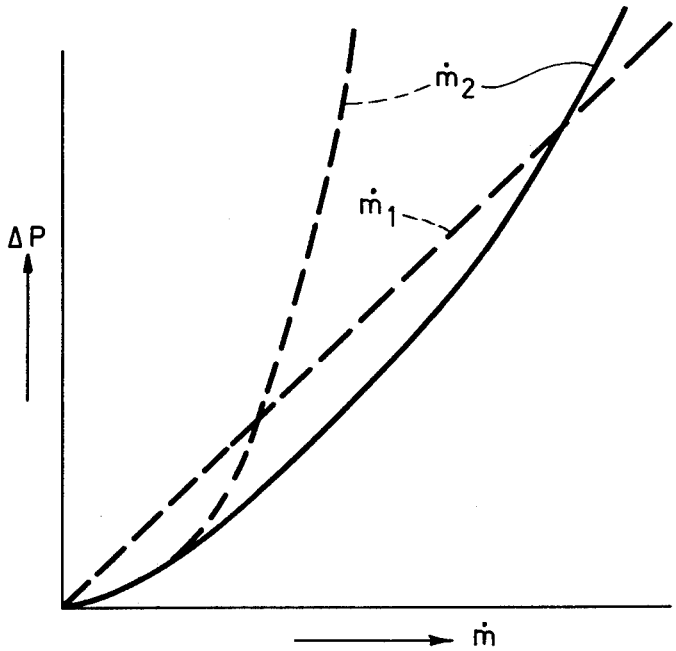

The broken curves in FIG. 2*a* represent pressure-difference versus mass-flow characteristics for the restrictions in the combustion air duct and the flue-gas return duct of the device according to U.S. Pat. No. 3,846,985, while the uninterrupted curve represents the passage characteristic for the flue-gas return duct which has changed due to the pressure drop in the exhaust.

Figure 2B:
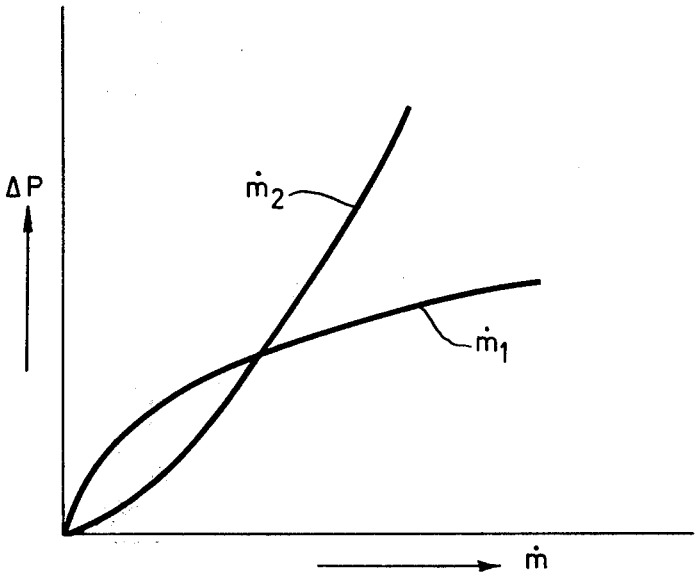

FIG. 2*b* shows the latter curve of FIG. 2*a* in relationship with the new pressure-difference versus mass-flow characteristic of the restriction in the combustion air inlet duct.

Figure 3:
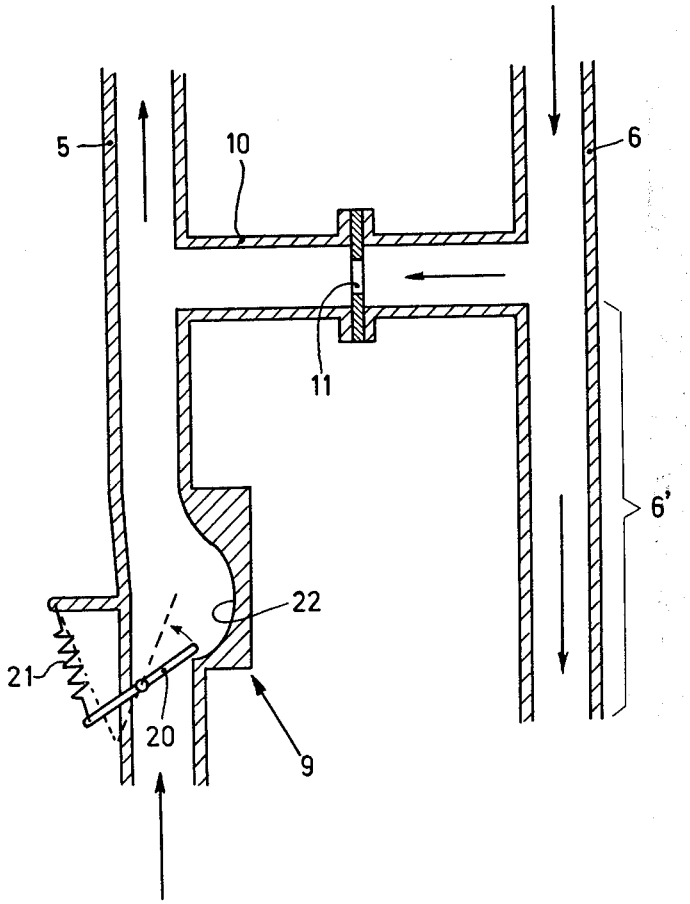

FIG. 3 shows a part of a combustion air inlet/flue gas recirculation system.

DETAILED DESCRIPTION OF THE PREFERRED EMBODIMENT

Figure 1:
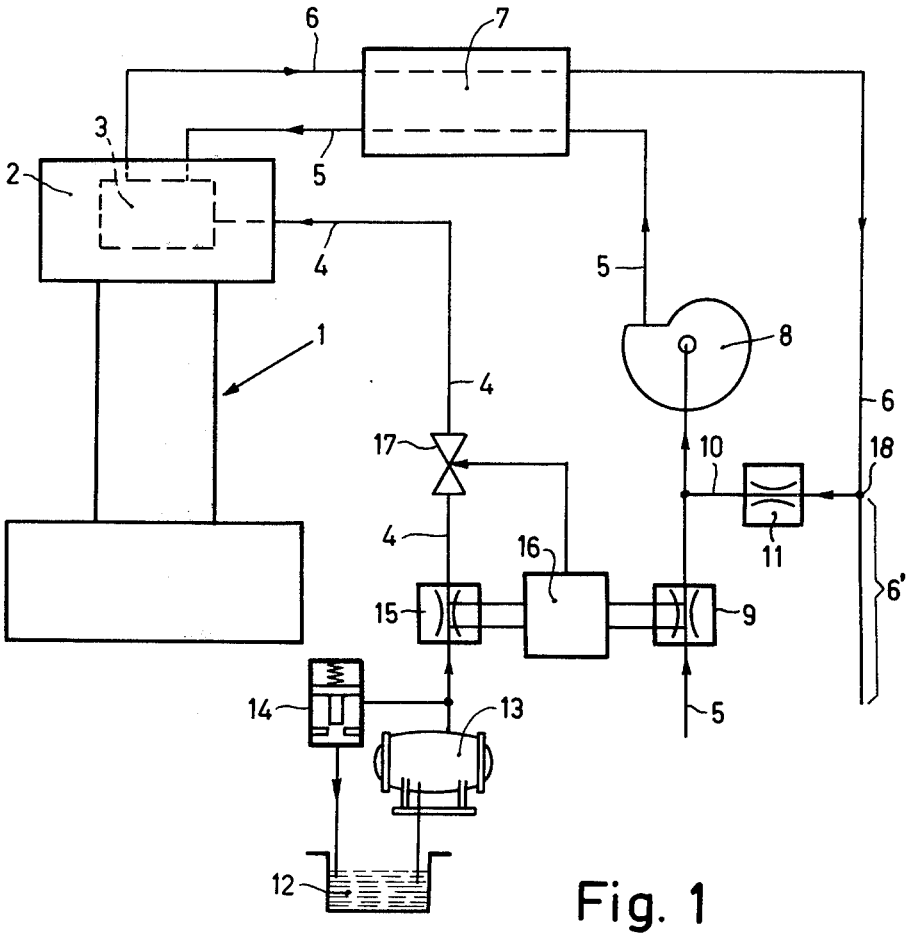
FIG. 1 shows a hot-gas engine incorporating flue gas recirculation and a control system for controlling the air/fuel ratio.

The reference 1 in FIG. 1 denotes a hot-gas engine which is an engine in which a working medium in a closed working space completes a thermodynamic cycle during operation. External heat, originating from an external combustion process involving a burner unit 2, is applied to this working medium. The burner unit 2 comprises a combustion chamber 3 having connected thereto a fuel inlet duct 4, a combustion air inlet duct 5 and an outlet duct for flue gases 6. The combustion air inlet duct 5 and the flue gas outlet duct 6 incorporate a heat exchanger 7, referred to hereinafter as preheater, in which combustion air is preheated on its way to combustion chamber 3 by flue gases discharged from the combustion chamber. The combustion air is drawn in by a fan 8.

The combustion air inlet duct 5 incorporates a first restriction 9 on the suction inlet side of fan 8. Provided between the flue gas outlet duct and the combustion air inlet duct 5, is a flue gas return duct 10 which is connected to the part of the combustion air inlet duct 5 which is located between the fan 8 and the first restriction 9. A second restriction 11 is provided in flue gas return duct 10.

Fuel from a fuel reservoir 12 is applied to combustion chamber 3 by way of a fuel pump 13. A relief valve 14 ensures that the pressure on the outlet of fuel pump 13 is constant. Fuel inlet duct 4 incorporates a third restriction 15. During operation of the engine, the pressure differences prevailing across the restrictions 9 and 15 are applied to a control member 16 which operates a control valve 17 in the fuel inlet duct 4 in order to adapt the fuel flow to the combustion air flow in duct 5.

According to U.S. Pat. No. 3,846,985 restriction 9 is of the laminar type for which, regardless of the suction inlet pressure of fan 8, the flow of combustion air through this restriction is always laminar.

The mass flow of air which is allowed to pass through laminar restriction 9 is then always substantially directly proportional to the pressure difference across this restriction.

At the same time, according to the said Application restriction 11 is a turbulent restriction, so that the flow of flue gas through this restriction is always turbulent. The mass flow of flue gas which is drawn from the flue gas outlet duct 6 via the flue gas return duct 10 by the fan 8 is then always substantially proportional to the root of the pressure difference across this restriction.

If there is no pressure drop, or substantially none, in part 6' of flue gas outlet duct 6, so that at the connection point 18 of the flue gas return duct 10 substantially ambient pressure prevails, like on the inlet of restriction 9, the relationship between the mass flow of combustion air or the recirculated flue gas, respectively, and the pressure difference prevailing across the relevant restriction is as denoted in FIG. 2*a* by the broken curves.

The pressure difference $\Delta P$ is plotted in the vertical direction, while the mass flow $\dot{m}$ is horizontally plotted.

The reference $\dot{m}_1$ denotes the characteristic for the combustion air mass flow, while the reference $\dot{m}_2$ denotes the characteristic for the recirculated mass flow of flue gas.

It follows from the curves that as the load of the engine increases, involving an increased supply of combustion air, the ratio $\dot{m}_2/\dot{m}_1$ decreases. However, if the part 6' of the duct exhibits a comparatively large pressure drop, with the result that at the area of the connection 18 a pressure prevails which is higher than the ambient pressure, the curve for the returned flue gas mass flow $\dot{m}_2$ changes as represented by the solid curve.

In order to obtain a favorable flue gas recirculation characteristic again, the restriction 9 in the combustion air inlet duct 5 of FIG. 1 is constructed such that the mass flow of combustion air passing through this restriction is proportional to the power 3/2 of the pressure difference prevailing across this restriction, or: $\dot{m}_1 = C \cdot (\Delta P)3/2$, in which $C$ is a constant.

Conversely, this can also be written as: $\Delta P = C_1 \cdot \dot{m}_1 2/3$. The solid curve of FIG. 2*a* for the recirculated mass flow of flue gas $\dot{m}_2$ and the curve for the combustion air flow $\dot{m}_1$ through the modified restriction 9, the latter curve satisfying the relation $\dot{m}_1 = C \cdot (\Delta P)3/2$, are shown together in FIG. 2*b*.

FIG. 2*b* shows that as the combustion air flow $\dot{m}_1$ increases, i.e. as the load of the engine increases, the ratio $\dot{m}_2/\dot{m}_1$ decreases. Consequently, at smaller loads, a comparatively larger quantity of flue gas is returned to the combustion chamber than at larger loads, which is desirable.

FIG. 3 shows a part of the combustion air inlet/flue gas recirculation system of FIG. 1 in a practical embodiment. The same reference numerals have been used for corresponding parts. Restriction 11 consists of a diaphragm. Restriction 9 in the combustion air inlet duct 5 consists of a valve 20 which is normally closed under the influence of a tensile spring 21, but which is opened against the spring pressure when air is drawn in (by the fan or engine) due to the sub-atmospheric pressure occurring above the valve. Spring 21 and the shape of surface 22, determining the passage at a given position of the valve, have been chosen such that the relation $\dot{m}_1 = C \cdot (\Delta P)3/2$ is satisfied.

It is obvious that other embodiments of the restriction 9 are feasible. For example, a spring-loaded valve body can be coaxially arranged inside duct 5 so as to release a profiled passage more or less by axial displacement.

What is claimed is:

1. A device for converting calorific energy into mechanical energy, comprising at least one combustion chamber having connected thereto at least one inlet duct for fuel, at least one inlet duct for combustion air in which a first restriction is incorporated, and at least one outlet duct for flue gases, a flue gas return duct being provided having an inlet and an outlet, the inlet being connected to the flue gas outlet duct and the outlet to the part of the combustion air inlet duct which is situated between the combustion chamber and the first restriction, the flue gas return duct incorporating a second restriction which is constructed such that the mass flow of flue gas which passes through in each operating condition of the device is at least substantially proportional to the root of the pressure difference prevailing across the second restriction, characterized in that the first restriction is constructed such that the mass flow of air passing through in each operating condition of the device is proportional to the power M of the pressure difference prevailing across the first restriction, where $1 < M \leq 3/2$.

2. A device as claimed in claim 1, constructed as a hot-gas reciprocating engine in which the ratio of the quantities of combustion air and fuel to be supplied to the combustion chamber is controlled by way of a control system comprising a control member which is controlled by signals originating from a pressure-difference gauge in the combustion-air inlet duct and the fuel inlet duct, respectively, characterized in that the first restriction constitutes the pressure-difference gauge in the combustion air inlet duct, whilst the pressure-difference gauge in the fuel inlet duct is formed by a third restriction of a construction such that the mass flow of fuel which passes through in each operating condition of the hot-gas reciprocating engine is proportional to the power N of the pressure difference prevailing across the third restriction, where $N = M$.

3. In a combustion engine operable with a source of fuel, and a source of air, and including a combustion chamber, a first duct including a first restriction means therein, for flowing air from said air source to said chamber, a second duct for discharging flue gas from said chamber, a third duct for return flow of flue gas from said second duct to an inlet into said first duct intermediate said first restriction means and said chamber, and a fourth duct for flowing fuel from said fuel source to said chamber, the improvement in combination therewith of a control system for said fuel and air flows wherein said second restriction means is the turbulent type permitting mass flow of flue gas, $\dot{M}_2$, which is at least substantially proportional to the root of the pressure difference prevailing across said second restriction means, and said first restriction means is the laminar type permitting mass flow of air, $\dot{M}_1$, which is proportional to the power M of the pressure difference prevailing across the first restriction, where $1 < M \leq 3/2$.

4. Apparatus according to claim 3 wherein said engine is a Stirling cycle hot gas engine.

5. Apparatus according to claim 3 wherein said control system further comprising a third restriction means in said fourth duct permitting a mass flow of fuel therethrough proportional to the power N of the pressure difference prevailing across said third restriction means, where $N=M$, said first and third restriction means provide signals corresponding to the respective pressure differences thereacross, said apparatus further comprising a valve in said fourth duct for controlling the fuel flow therethrough, and a control member for receiving said signals from said first and third restriction means and controlling said valve correspondingly.

* * * * *

UNITED STATES PATENT AND TRADEMARK OFFICE

CERTIFICATE OF CORRECTION

PATENT NO. : 3,935,708

DATED : February 3, 1976

INVENTOR(S) : AREND HARREWIJNE ET AL

It is certified that error appears in the above-identified patent and that said Letters Patent are hereby corrected as shown below:

Column 3, line 23, "1:3.16" should be --1:13.6--

Signed and Sealed this

*twenty-fifth* Day of *May 1976*

[SEAL]

*Attest:*

RUTH C. MASON
*Attesting Officer*

C. MARSHALL DANN
*Commissioner of Patents and Trademarks*